US005644342A

United States Patent [19]

Argyres

[11] Patent Number: 5,644,342

[45] Date of Patent: Jul. 1, 1997

[54] ADDRESSING SYSTEM FOR AN INTEGRATED PRINTHEAD

[75] Inventor: Dimitri Argyres, Corvallis, Oreg.

[73] Assignee: Hewlett-Packard Company, Palo Alto, Calif.

[21] Appl. No.: 381,008

[22] Filed: Jan. 30, 1995

Related U.S. Application Data

[63] Continuation of Ser. No. 40,781, Mar. 31, 1993.

[51] Int. Cl.[6] ..... B41J 29/38; B41J 2/05

[52] U.S. Cl. ..... 347/12; 347/57

[58] Field of Search ..... 347/12, 57, 180, 347/181, 182, 58, 59

[56] References Cited

FOREIGN PATENT DOCUMENTS 63-51142 4/1988 Japan ..... 346/140

OTHER PUBLICATIONS

IBM Technical Disclosure Bulletin vol., 25, No. 11A Apr., 1983 "Multiple Drivers for A Drop–On–Demand Print Head" G.L. Ream.

*Primary Examiner*—Benjamin R. Fuller
*Assistant Examiner*—Craig A. Hallacher

[57] ABSTRACT

An integrated printhead which includes an M row by N column array of groups of ink jet elements wherein each group has a unique row and column address; a first addressing control coupled to the array of groups for selecting one of the M rows of the M row by N column array of groups of ink jet elements; and a second addressing control coupled to the array of groups for selecting one of the N columns of the M row by N column array of groups of ink jet elements. One individual group of ink jet elements is addressed by the first addressing and the second addressing controls. In a specific embodiment a third dimension of addressing is provided by a plurality of address line selects that are coupled to the ink jet elements in each group. In an alternate specific embodiment the resistance between the first addressing means and the second addressing means for each group of ink jet elements can be adjusted to balance the energy dissipated between the groups of ink jet elements. The unique three dimensional addressing system provides for high density integrated printheads that have significantly fewer interconnect pads, which will minimize costs and increase reliability.

20 Claims, 6 Drawing Sheets

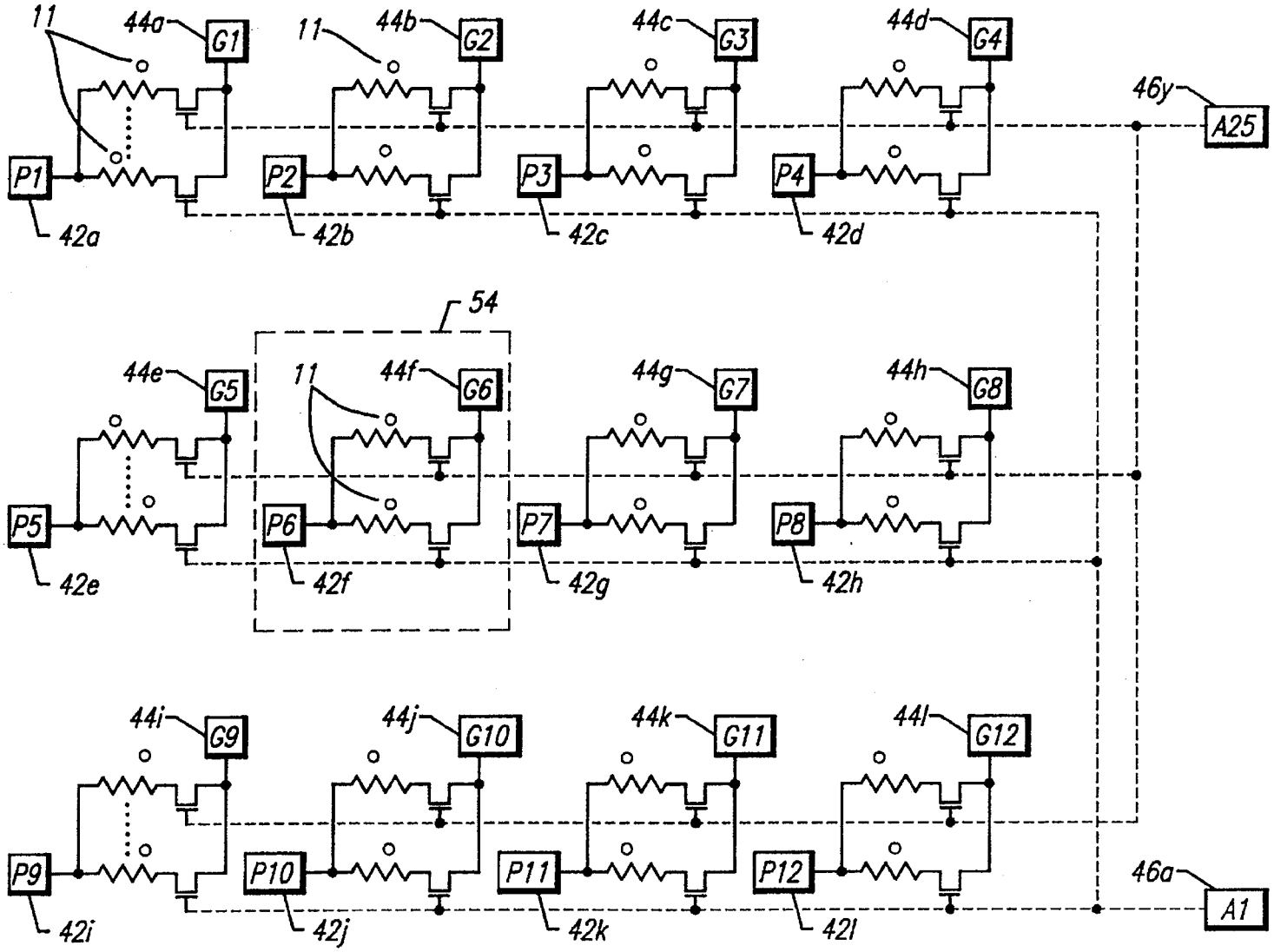
FIG. 1
CONVENTIONAL

ADDRESSING SYSTEM FOR AN INTEGRATED PRINTHEAD

This is a continuation of application Ser. No. 08/040,781, filed Mar. 31, 1993.

BACKGROUND OF THE INVENTION

1. Field of the Invention

This invention relates to thermal inkjet printing and more particularly to the selection for activation of heater resistors within an inkjet printhead to expel ink from nozzles corresponding to the heater resistors.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

2. Description of the Related Art

A major goal in an inkjet printer is to maximize print quality and speed while minimizing cost. To achieve this, more ink drop spray nozzles must be added to the pen while minimizing the circuit area needed. A major factor in chip area is the area of the interconnect pads which connect the die to the pen tape automated bonding (TAB) circuit. Decreasing the amount of interconnect pads on the chip not only reduces die area and cost but also tape automated bonding (TAB) circuit area as well as drive electronics in the product. The integrated drive head (IDH) is a means of reducing the printhead interconnect pads through the use of switching transistors formed on an integrated circuit substrate. The basic circuit consists of a heater resistor in series with a field effect transistor (FET) which controls the current through the resistor. By allowing current to flow through this resistor, power is dissipated in the resistor heating the ink and ejecting it through a nozzle. In the pen there are hundreds of these circuits.

A conventional printhead has 200 nozzles and is designed with 8 groups of 25 pairs each consisting of a heater resistor in series with a field effect transistor (FET). Each group has 1 primitive select, 1 ground and 25 address lines which are shared between all groups. Therefore for 8 groups of 25 pairs, there are a total of 8+8+25=41 interconnect pads required. To implement a 300 nozzle printhead, it is necessary to increase the number of groups to 12 resulting in 12+12+25=49 interconnect pads to the printhead. FIG. 1 is an illustrative schematic diagram of a conventional two dimensional address control for a 300 nozzle integrated printhead having 12 primitive selects × 25 address selects. The grounds are not used for addressing and are always tied to a common ground. To turn on a particular transistor, one drives high the associated primitive select and address line select.

For purposes of this present patent document only, the phrase "individual nozzle driver" means the aggregate of one or more electrical components associated closely with each individual nozzle.

For example in FIG. 1 at a representative unit position near lower left in the circuit array the "individual nozzle driver" includes one heater resistor 22 and one transistor 20. For purposes of clarifying the definition only: if ground leads were used for addressing (not part of the prior art shown), the "individual nozzle driver" could in purest principle include only one electrical component, namely a resistor.

If desired, the representative individual nozzle driver of FIG. 1 may also be deemed to include the intimately associated interconnect terminals 44*j*, 42*j*. In a sense these terminals are electrical components.

As another clarifying example, consider a piezoelectric inkjet system such as that described in IBM Technical Disclosure Bulletin, Vol. 25, No. 11A (April 1983), by G. L. Ream, entitled "Multiplex Drivers for a Drop-on-Demand Print Head". Each unit assemblage of a DOD crystal, resistor and diode shown in FIGS. 2 and 3 of that paper is an "individual nozzle driver".

(This definition may require equivalent interpretation, to the extent that components in some types of inkjet systems may be shared by a small number of nozzles, e.g. say two or three nozzles, within the printhead.)

The conventional two dimensional multiplexing scheme for printheads has the disadvantages that as the print quality and the number of nozzles increases, the number of interconnect pads to the printhead increases, which increases the printhead cost and both the die and tape automated bonding (TAB) area. This in turn increases the number and cost of the drive electronics and printer flex. In addition, more interconnect pads reduce product reliability and reduce the area available for additional circuitry for electro-static discharge (ESD) protection.

Accordingly, there is a need in the art for a system and/or technique for reducing the number of interconnect pads for a high density integrated printhead to minimize costs and increase the reliability thereof.

SUMMARY OF THE INVENTION

The need in the art is addressed by an integrated printhead of the present invention which includes an M row by N column array of groups of ink jet elements wherein each group has a unique row and column address, a first addressing control coupled to the array of groups for selecting one of the M rows of the M row by N column array of groups of ink jet elements, and a second addressing control coupled to the array of groups for selecting one of the N columns of the M row by N column array of groups of ink jet elements. One individual group of ink jet elements is addressed by the first addressing and the second addressing controls.

In a specific embodiment a third dimension of addressing is provided by a plurality of address line selects that are coupled to the ink jet elements in each group.

In an alternate specific embodiment the resistance between the first addressing means and the second addressing means for each group of ink jet elements can be adjusted to balance the energy dissipated between the groups of ink jet elements.

The unique three dimensional addressing system provides for high density integrated printheads that have significantly fewer interconnect pads, which will minimize costs and increase reliability.

BRIEF DESCRIPTION OF THE DRAWINGS

FIG. 1 is an illustrative schematic diagram of an integrated printhead having a conventional two dimensional address control.

DESCRIPTION OF THE INVENTION

Figure 2A:
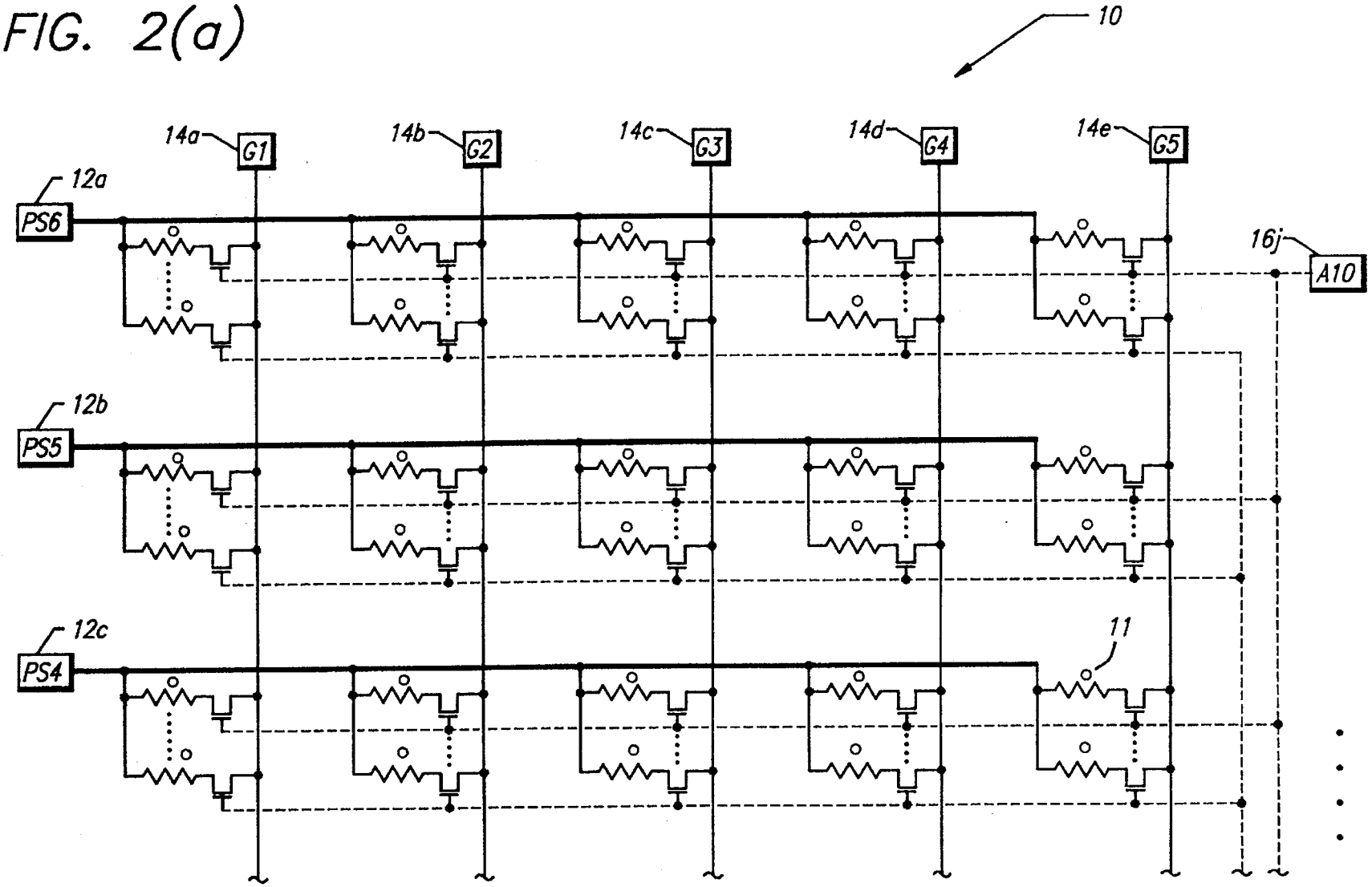
FIG. 2 is an illustrative schematic diagram representation of an integrated printhead having a three dimensional address control, and constructed in accordance with the present invention.
Figure 2B:
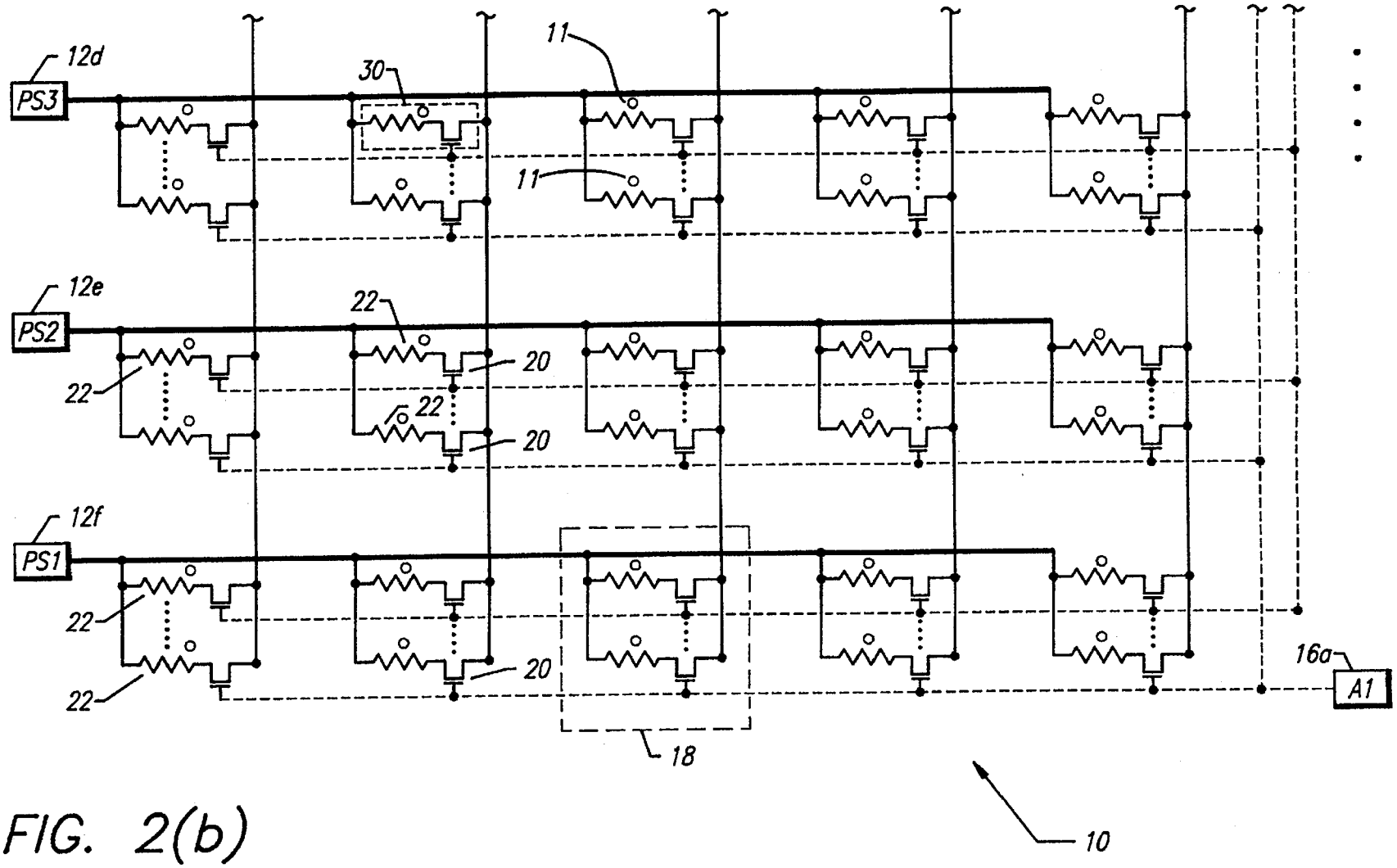

Illustrative embodiments and exemplary applications will now be described with reference to the accompanying drawings. The advantageous design and operation of the three dimensional addressing for an integrated printhead 10 of the present invention is best described with reference to FIG. 2, which is an illustrative schematic diagram representation of a three dimensional address control for an integrated printhead constructed in accordance with the present invention. In FIG. 2 an M by N array of groups 18 of ink jet elements are addressed by M primitive selects 12 and N ground selects 14. Each primitive select 12 is coupled to the groups 18 in one of the M rows of the M row by N column array of groups 18 and provides a first dimension of addressing. Similarly, each ground select 14 is coupled to the groups 18 in one of the N columns of the M row by N column array of groups and provides a second dimension of addressing. Each group 18 of ink jet elements has multiple heater resistor and transistor pairs 30, which each have a field effect transistor 20 with the drain of the field effect transistor 20 connected in series with a heater resistor 22. A nozzle orifice 11 is associated with each heater resistor, as is well known in the art. The primitive selects 12 are connected to the heater resistors 22 of the heater resistor and transistor pairs 30 in a group and the ground selects 14 are connected to the source of the field effect transistors 20 of each heater resistor and transistor pair 30 in a group. The gate of each field effect transistor 20 in a group 18 is controlled by an address line select 16, which provides a third dimension of addressing. There are as many address line selects 16 as there are heater resistor and transistor pairs 30 in a group 18 of ink jet elements.

A particular nozzle, heater resistor and transistor pair in FIG. 2 can be addressed by three numbers with the first number being the primitive select 12, the second number being the ground select 14, while the third number being the address line select 16. Hence (4,2,8) refers to primitive the fourth select, ground select second and eighth address line select. The nomenclature (2,4,x) refers to a group 18 associated with the second primitive select fourth and ground select. In FIG. 2 there are 6 primitive selects, 5 ground selects 12 through 14 and 10 address line selects 16, which provide addressing control to 6×5×10=300 heater resistor and transistor pairs for a three hundred nozzle pen, but only require a total of 6+5+10=21 interconnect pads to the printhead.

Other combinations of numbers of primitive selects, ground selects, and address line selects are possible as long as the number of primitive selects 12, ground selects 14 and address line selects 16 multiplied together equal the number of nozzles for the pen. Hence for a three hundred nozzle pen (3,10,10), (10,10,3), and (12,5,5) for the number of primitive selects, ground selects, and address line selects are all workable combinations.

A particular ink jet element consisting of a heater resistor and transistor pair 30 is turned on by setting the respective ground select 14 low, the respective primitive select 12 high and the respective address line select 16 high, which turns the field effect transistor 20 on and therefore current flows through heater resistor 22, heating the ink and ejecting it from the nozzle associated with the heater resistor. A particular heater resistor and transistor pair 30 is turned off by setting the respective address line select 16 low, or setting the respective primitive select 12 low, or setting high or floating the respective ground select 14.

FIG. 1 is an illustrative schematic diagram of an integrated printhead having conventional two dimensional address control. In the conventional system each group 54 has its own unique group select 42*a*–42*l* with its respective interconnect pad and its own unique ground 44*a*–44*l* interconnect pad. The address line selects 46*a*–46*y* operate similar to the operation of the address line selects 16 of FIG. 2. To turn on a particular transistor, thereby operating the associated heater resistor to fire the associated nozzle 11, one drives high the respective primitive select and address line select. The grounds 44*a*–44*l* are not used for addressing and are tied to a common ground off the integrated printhead. For the 12*25=300 heater resistor and transistor pairs of FIG. 1 there are 12+12+25=49 interconnect pads required. The present invention allows a drastic reduction from 49 interconnect pads in the conventional two dimensional address control to only 21 interconnect pads.

Figure 3:
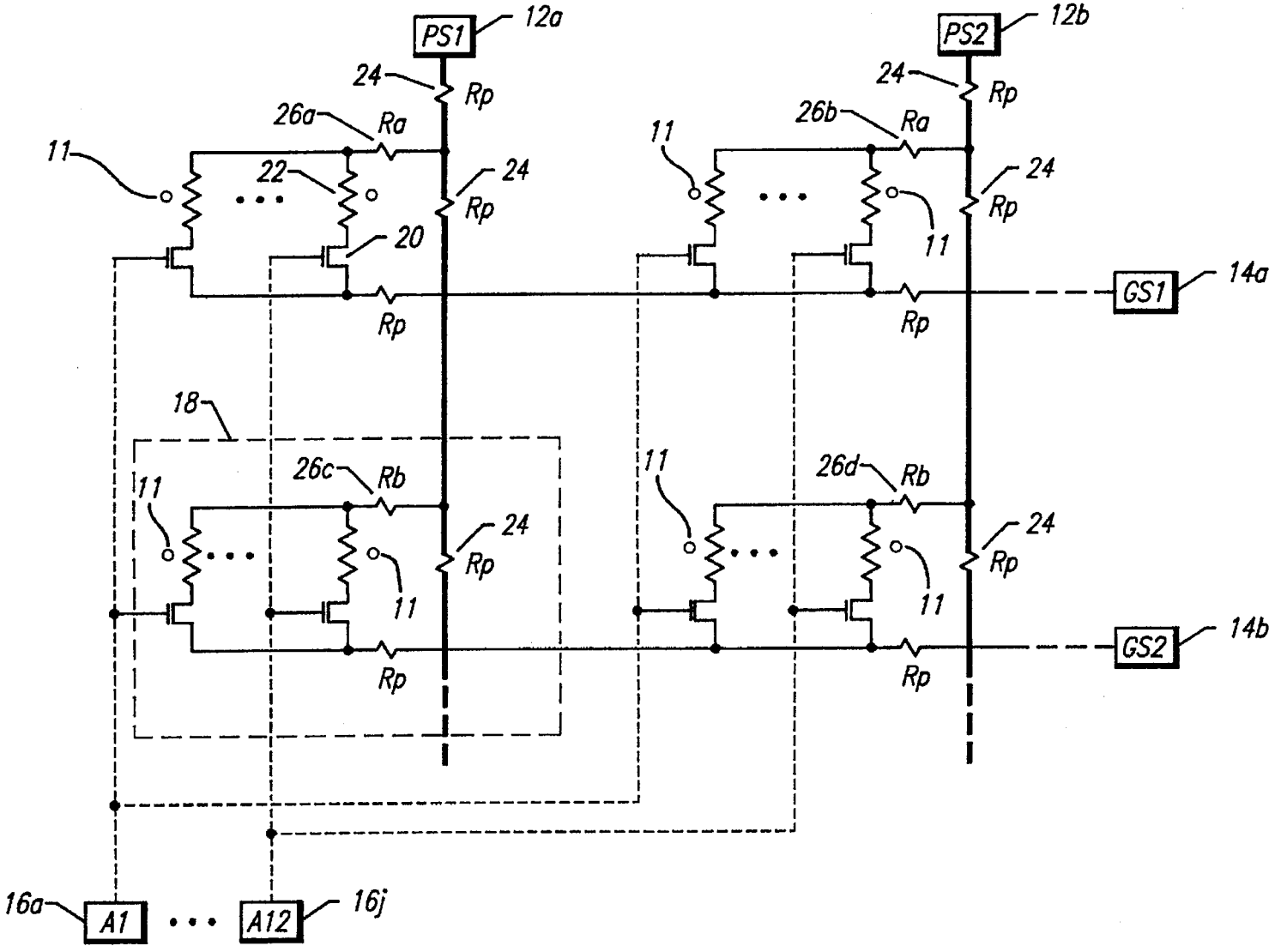
FIG. 3 is a like diagram of for an integrated printhead having three-dimensional address control, and showing adjustment resistors in accordance with the present invention.

FIG. 3 is an illustrative schematic diagram of an integrated printhead having three-dimensional address control and showing adjustment resistors 26 and associated nozzle orifices 11 in accordance with the present invention. Depending on the location in the M by N array of groups 18, certain heater resistor and transistor pairs 30 have more or less total parasitic resistance 24 between them and the primitive selects 12 and ground selects 14 than other heater resistor and transistor pairs. To compensate for the differences in parasitic resistance, an adjustment resistor 26 is added into the circuit, which ensures that power dissipation $(V^2)/R$ across heater resistor 22, where V is the voltage across the heater resistor and R is the value of the resistance of the heater resistor remains essentially the same for all groups 18. In FIG. 3 the adjustment resistors 26*a*, 26*b*, 26*c*, and 26*d* are shown located between primitive selects 12 and ground selects 14. The value of each of the adjustment resistors 26*a*, 26*b*, 26*c*, and 26*d* may be different. The value of each adjustment resistor is selected to ensure that all groups will dissipate the proper power.

Figure 4A:
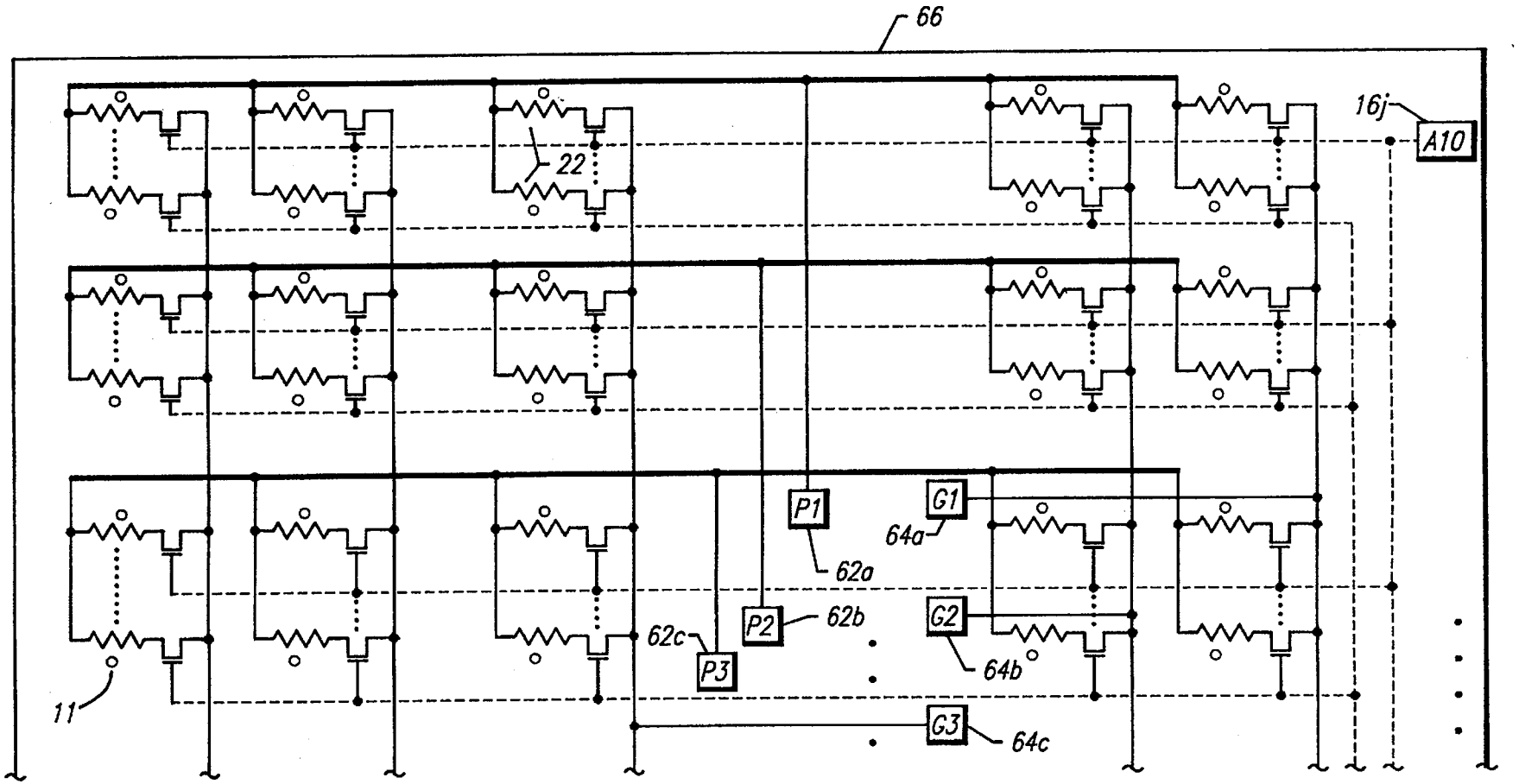
FIG. 4 is an illustrative schematic layout of an integrated circuit substrate showing the primitive select and the ground select interconnect pads located together in the center of an integrated circuit substrate and the array of groups each having a plurality of heater resistor and transistor pairs arranged peripherally around the interconnect pads in accordance with the present invention.
Figure 4B:
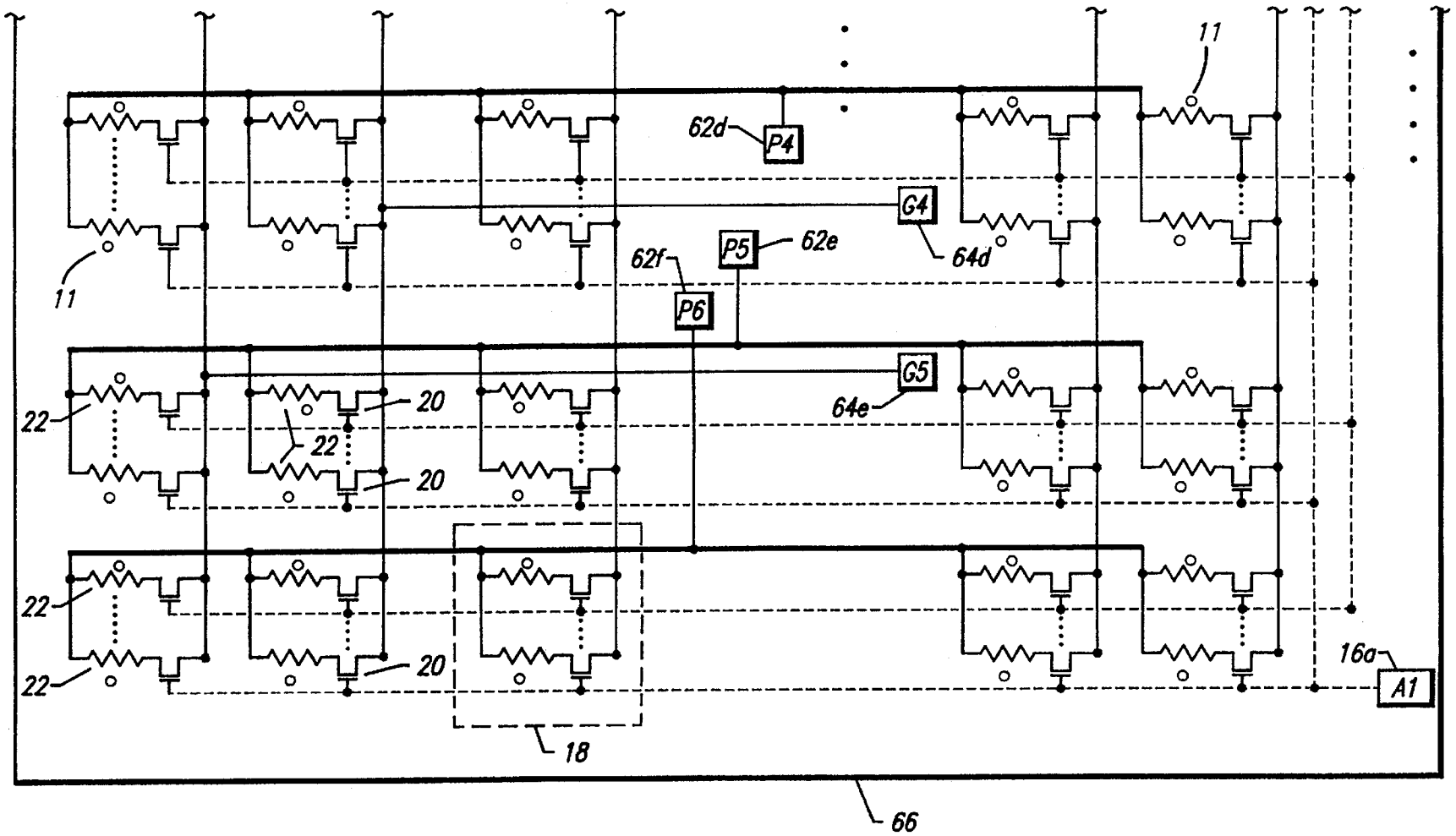

In the event that several heater resistor and transistor pairs 30 are turned on at once and have in common a shared primitive select 12 or shared ground select 14, then the current will increase as one nears the primitive select or ground select. Hence if two heater resistor and transistor pairs are turned on and the current goes through a single ground select, then the ground select will receive twice the current. If five pairs are turned on, then the ground select will receive five times the current and so on. Having five times the current may mean up to five times the normal voltage drop across the respective parasitic resistance which will result in a smaller voltage drop across one or more of the heater resistors 22. As explained above, power dissipation across the heater resistor is $(V^2)/R$, so less power will be dissipated. The number of transistors to be turned on at any time is variable; however, the ink drop volume and velocity do not vary a great deal above a certain threshold energy delivered to the heater resistor. The conventional configuration is structured so that the heater resistor always receives this amount of energy, because each group 54 of FIG. 1 has a unique primitive select 42. For the three dimensional addressing system of the present invention, the field effect transistors 20 are operated at a higher voltage so that when several transistors turn on at once, they all receive the threshold energy and when only one turns on the threshold energy is easily supplied. FIG. 4 is an illustrative schematic layout of an integrated circuit substrate showing the primitive selects 62*a*–62*f* and the ground selects 64*a*–64*e* interconnect pads located together in the center of an integrated circuit substrate 66 and the array of groups 18 each having a plurality of heater resistor and transistor pairs arranged peripherally around the interconnect pads in accordance with the present invention. The line lengths to each group 18 are reduced, which lowers the parasitic resistance. The address line selects 16 can be located in the center or along the edge of the integrated circuit substrate 66 without any effect on performance, because the current through the address line selects is minimal and therefore voltage drop across any parasitic resistance in the address lines is minimal.

Thus, the present invention has been described herein with reference to a particular embodiment for a particular application. Nonetheless, those having ordinary skill in the art and access to present teachings will recognize additional modifications, applications, and embodiments within the scope thereof. For example, the field effect transistors of the present invention may be replaced by other switching devices without departing from the scope of the present invention.

It is therefore intended by the appended claims to cover any and all such applications, modifications and embodiments within the scope of the present invention.

Accordingly,

What is claimed is:

1. An improved inkjet addressing system, for an integrated printhead having a multiplicity of inkjet nozzles; said system comprising:

a row-and-column array of groups of separate and distinct nozzle drivers;

each of said groups of separate nozzle drivers comprising a multiplicity of the separate nozzle drivers;

each of said groups of separate nozzle drivers having a unique row-and-column address;

first addressing means, coupled to said array of groups, for selecting one row of said array of groups; and second addressing means, coupled to said array of groups, for selecting one column of said array of groups;

wherein the first and second addressing means cooperate to select a particular group having a row-and-column address consisting of the row selected by the first addressing means and the column selected by the second addressing means, and the first and second addressing means select each of the separate nozzle drivers in said particular group of nozzle drivers.

2. The improved addressing system of claim 1, further comprising:

means for adjusting a resistance between said first addressing means and said second addressing means for at least one of said groups of individual nozzle drivers.

3. The improved addressing system of claim 2, wherein:

for each particular one of the at least one of said groups, said resistance-adjusting means further comprise an adjustment resistor located between said particular one group and said first addressing means.

4. The improved addressing system of claim 1, wherein:

said first addressing means comprise a number of primitive selects equal to the number of rows in the array; and each said primitive select is coupled to said groups of individual nozzle drivers in a respective row of said array of groups.

5. The improved addressing system of claim 4, wherein:

said second addressing means comprise a number of ground selects equal to the number of columns in the array; and each said ground select is coupled to said groups of individual nozzle drivers in a respective column of said array of groups.

6. The improved addressing system of claim 5, wherein:

each individual nozzle driver comprises a transistor coupled in series within each individual nozzle driver, respectively.

7. The improved addressing system of claim 6, wherein:

the primitive select for each particular row of said array is coupled to every said individual nozzle driver of that particular row; and the ground select for each particular column of said array is coupled to every said transistor of that particular column.

8. The improved addressing system of claim 7 further comprising:

a third addressing means coupled to said array of groups for selecting one respective individual nozzle driver in each said group of individual nozzle drivers.

9. The improved addressing system of claim 8, wherein:

said third addressing means further comprise a plurality of address lines, and a corresponding plurality of respectively connected address-line selects; and each said address line is coupled to a respective transistor in each group of individual nozzle drivers.

10. The improved addressing system of claim 9, wherein:

said transistors are field-effect transistors.

11. The improved addressing system of claim 1, wherein:

said first addressing means are coupled to interconnect pads located near the center of an integrated-circuit substrate;

said second addressing means are coupled to interconnect pads located near the center of an integrated-circuit substrate; and said array of groups of individual nozzle drivers is situated with some individual nozzle drivers at each side, respectively, of said interconnect pads.

12. The system of claim 1, wherein:

exactly one individual nozzle driver is respectively associated with, and actuates, each inkjet nozzle.

13. The system of claim 12 further comprising:

third addressing means, coupled to said array of groups, for selecting one respective individual nozzle driver in each said group of individual nozzle drivers.

14. The system of claim 13, wherein:

each individual nozzle driver comprises a transistor coupled in series with an individual nozzle driver, respectively.

15. The improved addressing system of claim 14, wherein:

said third addressing means further comprise a multiplicity of address lines and a corresponding multiplicity of address-line selects; and each said address line is coupled to a respective transistor in each group of individual nozzle drivers.

16. An integrated printhead having multiple inkjet nozzles, and having three-dimensional addressing comprising:

a row-and-column array of groups of separate and distinct nozzle drivers, wherein;

each of the separate nozzle drivers is respectively associated with one of the multiple inkjet nozzles, and each of said groups of separate nozzle drivers has a unique row-and-column address;

first addressing means, coupled to said array of groups, for selecting one row of said array and for connecting voltage or current to individual nozzle drivers in that selected row to partially enable printing by the nozzles associated therewith;

second addressing means, coupled to said array of groups, for selecting one column of said array and for connecting voltage or current to individual nozzle drivers in that selected column to partially enable printing by the nozzles associated therewith;

means for establishing a resistance between said first addressing means and said second addressing means, for each of said groups of individual nozzle drivers;

third addressing means, coupled to said array of groups, for connecting voltage or current to one respective individual nozzle driver in each of said groups of separate nozzle drivers to partially enable printing by the nozzles associated therewith; and means, coupled to said first addressing means, for adjusting the resistance-establishing means between said first addressing means and said second addressing means for at least one of said groups of individual nozzle drivers.

17. The system of claim 16, wherein:

said third addressing means comprise a transistor connected within each of the individual nozzle drivers, respectively.

18. The system of claim 17, wherein:

said third addressing means comprise a transistor connected within each of the individual nozzle drivers, respectively.

19. The system of claim 18, wherein:

each transistor has a control terminal;

one control terminal in each group is connected in common with one control terminal in substantially each other group, respectively, to form sets of commonly connected control terminals; and said third addressing means further comprise means for applying an actuating signal to a selected one of the commonly connected sets of control terminals.

20. An integrated printhead having a multiplicity of inkjet nozzles, and having three-dimensional addressing comprising:

a row-and-column array of groups of separate and distinct nozzle drivers wherein:

each of the separate nozzle drivers is respectively associated with one of the multiple inkjet nozzles, and each of said groups of separate nozzle drivers has a unique row-and-column address, said array of groups of separate nozzle drivers comprises a multiplicity of rows and a multiplicity of columns;

first addressing means, connected in common and substantially directly with every individual nozzle driver in one of the rows of the array, for partially enabling printing by the nozzles associated with that one of the rows;

second addressing means, connected in common and substantially directly with every individual nozzle driver in one of the columns of the array, for partially enabling printing by the nozzles associated with that one of the columns; and third addressing means, connected in common and substantially directly with one respective separate nozzle driver in each of said groups of separate nozzle drivers, for partially enabling printing by the nozzles associated with that one respective separate nozzle driver in each group.

* * * * *

UNITED STATES PATENT AND TRADEMARK OFFICE

CERTIFICATE OF CORRECTION

PATENT NO. : 5,644,342
DATED : July 1, 1997
INVENTOR(S) : Dimitri Argyres

It is certified that error appears in the above-identified patent and that said Letters Patent is hereby corrected as shown below:

At Column 3, lines 46 - 48, delete "Hence (4,2,8) refers to primitive the fourth select, ground select second and eighth address line select" and insert in lieu thereof --Hence (4,2,8) refers to the fourth primitive select, second ground select and eighth address line select--.

Signed and Sealed this

Thirty-first Day of March, 1998

Bruce Lehman

*Attest:*

BRUCE LEHMAN

*Attesting Officer*

*Commissioner of Patents and Trademarks*